US006296305B1

(12) United States Patent
Lamka et al.

(10) Patent No.: US 6,296,305 B1
(45) Date of Patent: Oct. 2, 2001

(54) FLOATABLE INFANT SAFETY SEAT

(76) Inventors: John A. Lamka, 2707 S. Wilke Rd., Rolling Meadows, IL (US) 60008; Robert M. Kot, 3935 N. Galesburg Ave., Arlington Heights, IL (US) 60004-1207; Cherisse I. Lamka, 2707 S. Wilke Rd., Rolling Meadows, IL (US) 60008

( * ) Notice: Subject to any disclaimer, the term of this patent is extended or adjusted under 35 U.S.C. 154(b) by 0 days.

(21) Appl. No.: 09/512,048

(22) Filed: Feb. 24, 2000

(51) Int. Cl.[7] ..... A47C 7/62

(52) U.S. Cl. ..... 297/184.13; 297/452.14; 297/452.19; 441/130

(58) Field of Search ..... 297/184.13, 250.1, 297/256.15, 452.14, 452.19, 452.65

(56) References Cited

U.S. PATENT DOCUMENTS 4,564,240 * 1/1986 Thieme ..... 297/452.14
4,725,253 * 2/1988 Politte ..... 441/130
4,798,551 * 1/1989 Dumonceaux et al. ..... 441/130
4,799,910 * 1/1989 Kellough ..... 441/130
5,187,826 * 2/1993 Mariol ..... 297/295 X
5,468,047 * 11/1995 Goor et al. ..... 297/184.13 X
6,036,563 * 3/2000 Walker ..... 441/130
6,059,360 * 5/2000 Bedard ..... 297/250.1
6,086,150 * 7/2000 Scheurer et al. ..... 297/452.19 X

* cited by examiner

*Primary Examiner*—Laurie K. Cranmer
(74) *Attorney, Agent, or Firm*—Paul H. Gallagher

(57) ABSTRACT

A safety seat including a one-piece shell made of molded plastic with reinforcing elements imbedded therein. The shell has an interior space opening to the exterior and including a seat for an infant. The shell includes a detachable bail for holding playthings for the infant. The seat has a wide bottom and a narrow, and small, top, and has weights imbedded in the bottom, effecting movement of the seat to upright position in the water.

14 Claims, 3 Drawing Sheets

FLOATABLE INFANT SAFETY SEAT

FIELD OF THE INVENTION

The invention resides in the field of a safety seat for infants that is floatable and therefore useful for infants in any circumstance near water.

SUMMARY OF THE INVENTION

A broad object of the invention is to provide a safety seat of the general character referred to, which is floatable in water, and which returns to an upright position in the water if it should fall into the water in any other position.

Another broad object is to provide a floatable infant safety seat that is effective for holding an infant therein, in safety condition, such as by a harness, but that is also effective for holding an infant in other circumstances not related to a water environment.

Another and more specific object is to provide such a safety seat having the following features and advantages.

1) The infant can be held in the seat in a comfortable position.

2) The seat is built of inexpensive materials, and therefore of low cost manufacture.

3) More specifically, the seat is made of foam material which is extremely light in weight, and strong, and can be specially shaped to provide the desired floatation effect.

4) Imbedded in the foam material is a core framework that facilitates shaping of the foam material and provides unusually great strength.

5) The device includes a bottom part forming a seat for holding the infant in upright position, and a canopy effective for turning the seat into upright position in the water, and providing a shade element for shading the infant.

6) The device has a specially shaped bottom surface on which it can rest on a dry surface, and be easily rocked for comforting the infant.

BRIEF DESCRIPTION OF THE INDIVIDUAL FIGURES OF THE DRAWINGS

Figure 15:
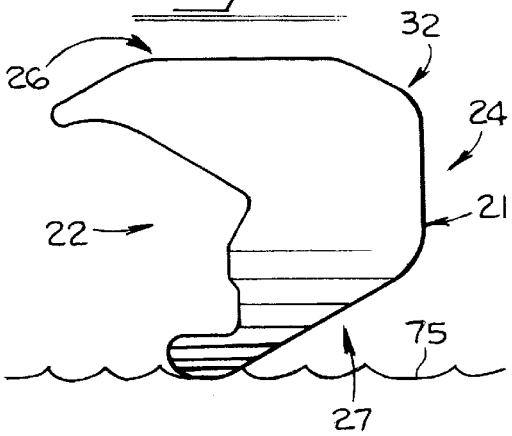
FIG. 15 is a side view showing the safety seat in inverted position, with the top element of the seat engaging the water.
Figure 15A:
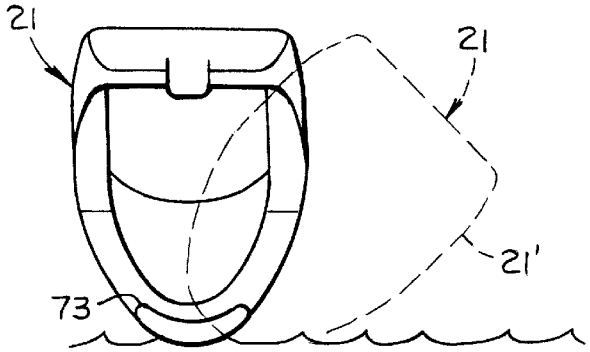

FIG. 15*a* is a view generally similar to FIG. 15, but shown from the front.

Figure 3:
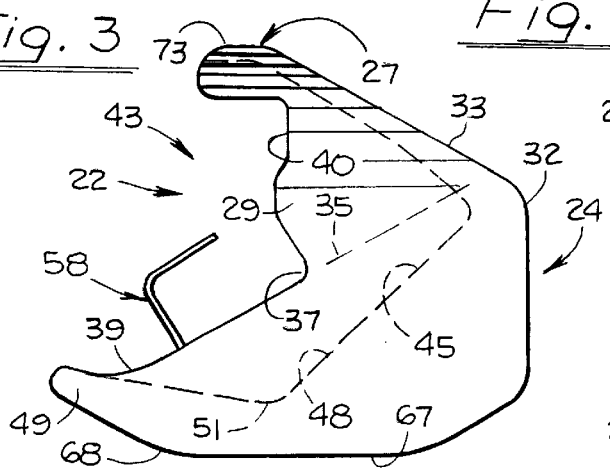
FIG. 3 is a side elevational view taken from the right of FIG. 1 as indicated by the arrow 3.
Figure 16:
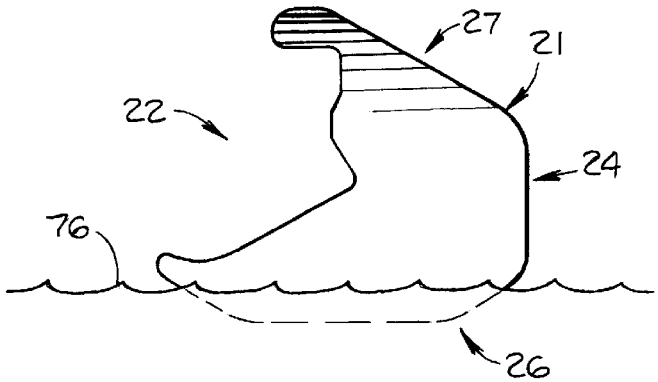

FIG. 16 is a view oriented according to FIG. 3, showing the safety seat in the water and indicating the depth to which it immerses.

Figure 17:
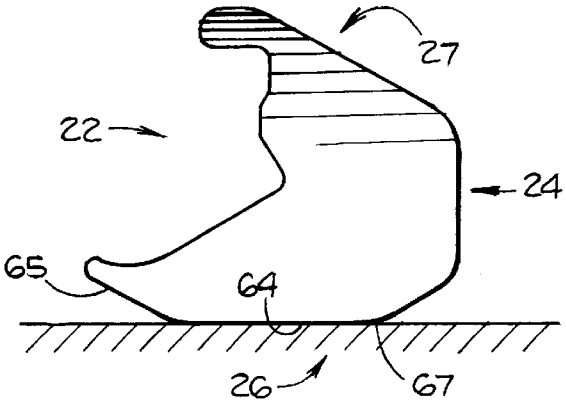

FIG. 17 is a view oriented according to FIG. 3, showing the safety seat resting on a floor.

Figure 18:
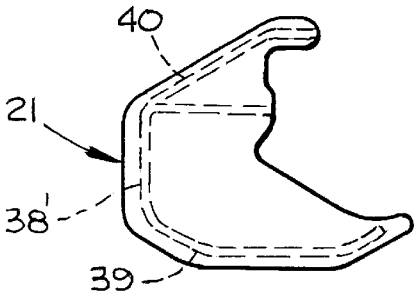

FIG. 18 is a side view showing reinforcing rods embedded in the device.

Figure 19:
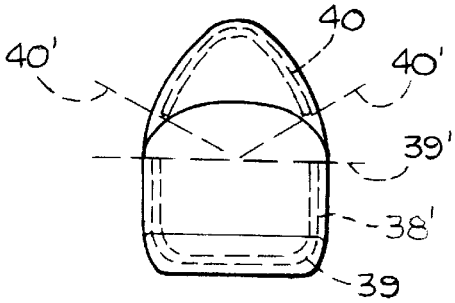

FIG. 19 is a rear view showing reinforcing rods embedded in the device.

DETAILED DESCRIPTION OF THE DRAWINGS

FIGS. 1–6 show the safety seat of the invention in overall view. It is oriented in upright position in these views as if resting on a floor. The device mainly is in the form of a shell 21 having a front end 22 and a rear end 24. It has a bottom 26, a top 27, a right side 29, and a left side 30. The sides of the device are identified according to its stationary attitude, i.e., right and left according to the respective sides of an observer viewing the device from the front, as in FIG. 1.

The shell 21 is made up of a single one-piece integral article. It is made up basically of a plastic material 31 that can be applied as foam and which hardens after being applied, or instead, it may be molded of plastic material 31 that is adapted to injection molding processes, if desired.

The shell 21 (FIG. 3) includes what may be referred to for convenience as a bottom section 32 and a canopy 33. A line 35 delimits the upper surface of the bottom or lower section 32, at the right of the latter, and lies between the bottom section 32 and the canopy 33, but the canopy 33 is integral with the bottom section 32 as indicated above. The juncture between the bottom section 32 and the canopy 33 is indicated by a line 36 in FIG. 1, and as a point 37 in FIGS. 2 & 3.

In forming the shell 21, the plastic 31 is put in place around a supporting structure 38 which includes rods 38' and a wire mesh 38" interconnecting the rods 38'. Attention is directed to FIGS. 18 & 19 showing the shell 21; as the plastic 31 is put in place, the supporting structure 38 is imbedded in the plastic 31. The steel rods 38', are of U-shape, as shown at 39 below the axis line 39', and at 40 above the axis lines 40'. The wire mesh 38" stretches across the transverse extent of the shell 21. In other words, the rods 38' and mesh 38" form a skeleton frame work for supporting the plastic material 31 for providing strength and also in part, shape of the parts of the shell 21. As the formation of the shell 21 proceeds, plastic material 31 is added and applied over the entire mesh 38" and rods 38'. In this process, the plastic 31 of course, is elastic and can be shaped, and as it is applied, the mesh 38" is moved, or pushed, or flexed within reasonable limits to produce a desired shape, within small limits, to provide a desired shape for comfort for the infant 42. The supporting structure 38, including the rods 38' and mesh 38", not only allows a specific shape to be formed, but provides unusual strength. The plastic material 31 after having hardened, assumes substantial strength of its own, but the strength of the supporting structure 38 is added thereto to provide the total and unusually great strength to the entire shell 21.

Those portions that may be referred to as walls or wall elements, such as at 41, may be for example of 2½–3 inches in thickness. These dimensions are only examples and they may be of any thickness within a wide range.

The relative positioning of the bottom section 32 and the canopy 33 is such as to form an interior space or cell 43 (FIG. 7) in which the infant 42 is placed in the use of the safety seat. This cell 43 opens longitudinally through the front end, and is directed near the horizontal, as oriented in side view, along the axis 44.

The bottom section 32 at the rear, as seen in FIG. 3, at 45, is relatively thick in vertical dimension. This thick portion provides great flotation effect and has an inclined top surface 48 for comfort of the infant 42. The top surface 48 is inclined upwardly and rearwardly at a substantial angle. The front portion 49 of the bottom section 32 has an upper surface 50 that slopes inwardly and downwardly, joining the surface 48 at 51 (see FIGS. 3, 7, 8). These two surfaces 48, 50 are so arranged that the infant 42 when lying on the top surface 48, his trunk is inclined upwardly enabling him to see the exterior, while the upper surface 50 is nearer the horizontal and more directly forms a seat on which the infant 42 sits. The shell 21 is fixed in structure and hence it is not necessary to move or remove anything to gain access to the interior.

Figure 1:
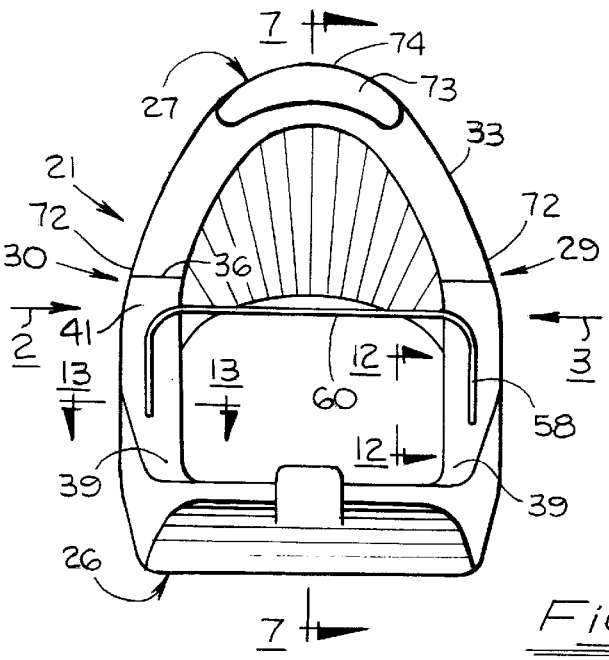
FIG. 1 is an elevational front view of the safety seat.
Figure 4:
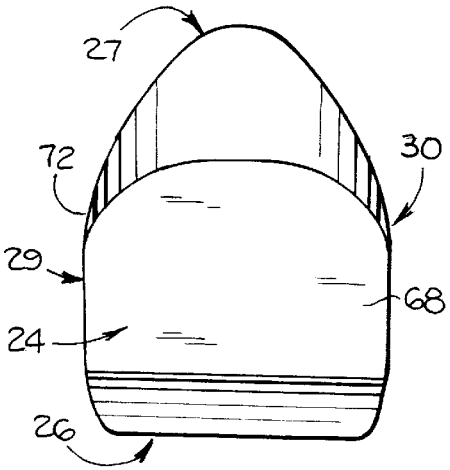
FIG. 4 is rear view.
Figure 5:
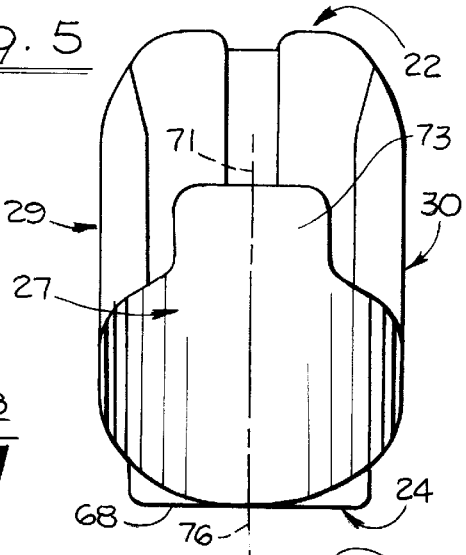
FIG. 5 is a top view.
Figure 2:
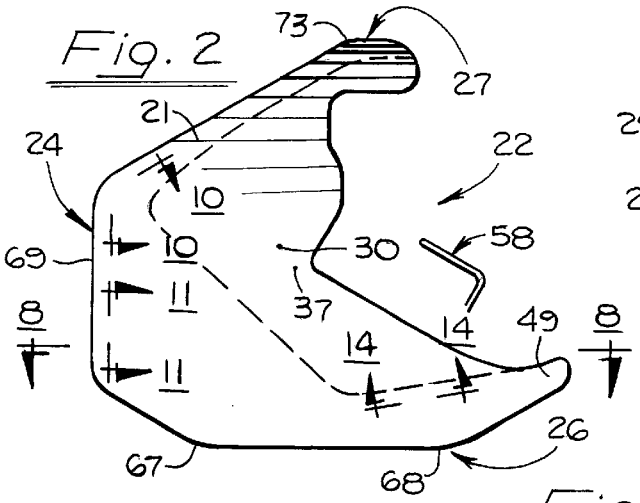
FIG. 2 is a side elevational view taken from the left of FIG. 1 as indicated by the arrow 2.
Figure 7:
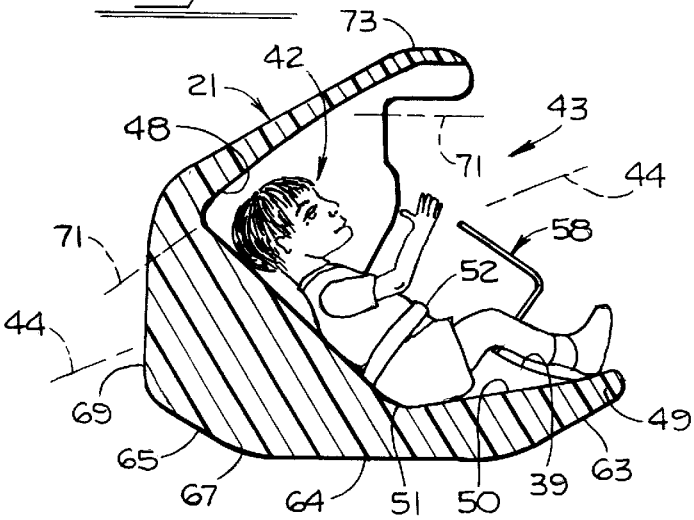
FIG. 7 is a vertical sectional view taken at line 7—7 of FIG. 1, and showing an infant therein.

The bottom section 32 is so formed that the wall elements 41 provide side arms at the sides of the infant seat. The canopy 33 is curved about an internal front-to-rear axis 71 (FIGS. 1, 5, 7). The top or outer convex surface of the canopy 33 approximates the cylindrical, and the side portions of the canopy 33 at 72 are disposed adjacent the vertical direction and merge into the side arms 41.

The canopy 33 at the front terminates upwardly in a center extension 73 directed generally forwardly, and its outer convex surface at its top peak 74 forms the highest point of the shell 21. This relationship will be referred to hereinbelow in describing the action of the device in the water. The outer convex surface approaches the spherical, for providing an essentially point engagement in the water.

The canopy 33 (FIGS. 5, 7) does not extend the full length of the bottom section 32. The extension 73 of the canopy 33 adds to the length of the canopy 33 for shade purposes, for shading the infant 42 when in position in the safety seat.

A bail 58 is detachably mounted in the walls 41 of the shell 21, which has a segment or cross bar 60 for holding play things for the infant 42.

Figure 6:
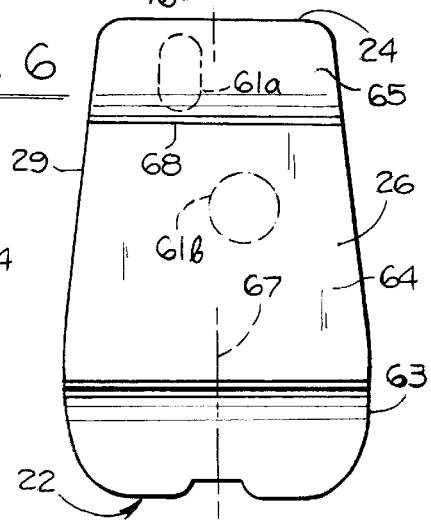
FIG. 6 is a bottom view.
Figure 9:
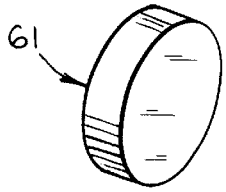
FIG. 9 is a perspective view of one of the weights imbedded in the device.
Figure 10:
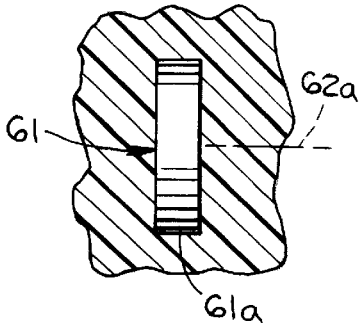
FIG. 10 is a sectional view taken at line 10—10 of FIG. 2 showing the weight of FIG. 9 imbedded in the plaster material forming the body of the device.
Figure 11:
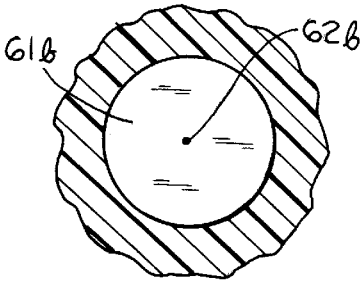
FIG. 11 is a sectional view taken at line 11—11 of FIG. 2 showing the weight of FIG. 9 imbedded in the plastic.
Figure 12:
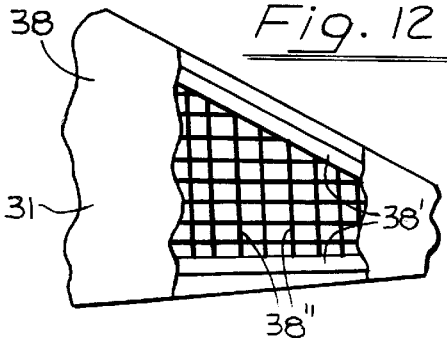
FIG. 12 is a view taken at line 12—12 of FIG. 1 being partially broken away and showing the strengthening steel wire mesh imbedded in the plastic.
Figure 13:
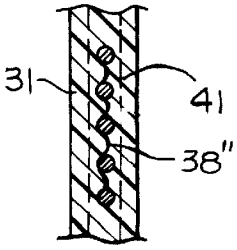
FIG. 13 is a sectional view taken at line 13—13 of FIG. 1.

For assisting in moving the seat to an upright position in the flotation step, weights 61 (FIG. 9) are utilized. These weights 61 as used herein are two in number and are individually identified 61*a* and 61*b* (FIGS. 10 & 11), and imbedded in the bottom 26 of the shell 21 as shown in FIG. 6. These weights 61*a*, 61*b* are preferably of cylindrical form but need not be of that exact shape. They are preferably approximately 5 lbs each in weight, although in this case also this dimension is not limiting. In the case of weight, 61*a*, it is positioned with its axis 62*a* transverse, while in the case of weight 61*b* it is positioned with its axis 62*b* longitudinal.

The bottom surface 26 of the shell 21 (FIGS. 2 & 6) is made up of three panels 63, 64, 65. The center panel 64 is the largest, and it joins the rear panel 65 in a rounded surface 67 forming a rocking beam as referred to below. The front panel 63 is disposed at an angle to the center panel 64 along a line 68. The rear surface 69 is approximately perpendicular to the center panel 64.

Figure 8:
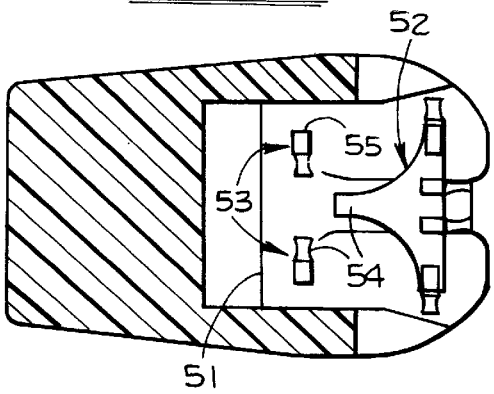
FIG. 8 is a horizontal sectional view taken at line 8—8 of FIG. 2.
Figure 14:
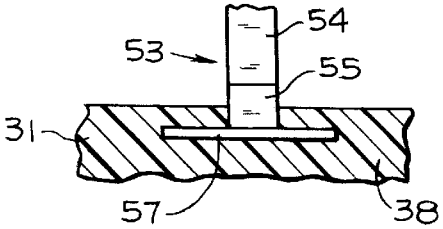
FIG. 14 is a sectional view taken at line 14—14 of FIG. 2.

A harness 52 is put in position in the shell 21 as shown particularly in FIGS. 7 & 8. This harness 52 is of known kind and need not be described in detail, but is put in position in the shell 21 or anchored therein (FIG. 14) by imbedding terminal elements 53 thereof in the plastic material 31 making up the shell 21. These terminal elements 53 include flexible straps 54 and anchoring elements 55 extending into and imbedded in the plastic material 31 and secured to a plate 57 securely held in the plastic material 31.

Considering the device as a safety seat, to be used as in a boat, as distinguished from resting on dry land, attention is directed to FIGS. 15, 15*a* in which the safety seat is shown in inverted position. The bottom section 32, and particularly in the rear portion thereof, is of great vertical thickness, and consequently of much greater mass than the canopy 33. By reason of this relationship, when the device is in the water, as from a fall or from being thrown into the water, and the top peak 74 is lowermost, the bottom section 32 tends to find the lowermost position with the canopy 33 extending upwardly. This feature, as presented in FIGS. 15, 15*a* is an extreme position. The top peak 74 in engaging the water, forms a fulcrum of minimum area which is basically a point contact. The great mass of the entire device extends upwardly therefrom and readily falls over, the weights 61 assisting in this rolling-over action.

The entire device is of low density, and sinks into the water only a short distance, as represented approximately in FIG. 16.

The position of FIGS. 15, 15*a* would persist for only an instant of time, because the bottom part of the seat is overwhelmingly greater than the top part and consequently the seat would turn over or actually roll over. Such action would be about the top peak 74, and in FIG. 15, the seat would roll toward the observer or in the opposite direction, or sideways. This sideways, rolling direction is shown more fully in FIG. 15*a*. In this figure, the seat is viewed from the front, and the dotted line positions 21' represent the rolling over action in sideways direction. The relatively narrow width of the seat determines its rolling sideways, and the flat side of the seat first engages the water. Because of the greater size of weight of the seat, which includes the weights 61, the rolling action continues and the bottom part moves the bottom position in the water and the canopy 33 to the upright position. The entire shell 21 is of substantial width, and thus is relatively stable when in an upright position.

One or both of the weights 61*a*, 61*b*, may be offset transversely to one side of the vertical longitudinal sectional plane 76, as shown in FIG. 6. This offset arrangement of the weights 61*a*, 61*b* adds to the rolling over of the device.

The top peak 74 is at a relatively great height compared with the width of the shell 21, and when the shell 21 is in inverted position (FIG. 15) this relatively great height adds to the rolling over action. The dimensions of the shell 21 may be: length of bottom section 32 27"; length of canopy 33 21"; width 16"; weight approximately 15 lbs. (with the weights 61); but these dimensions and values may be varied.

While the device is primarily a safety seat for floatation in water, it is also well adapted to accommodating an infant 42 on dry land, such as on a pier or on the beach, or in the house. In any setting, or environment, it may be used for holding an infant 42, releasing the parent from constant attention. The canopy 33 serves as a shield from the sun.

The center panel 64 is so positioned that it rests fully on the floor 80 (FIG. 3), when the device is positioned thereon, and serves to hold the seat upright. The juncture surface 67 between the center panel 64 and the rear panel 65, is rounded, or of long-radius cylindrical shape, facilitating rocking of the seat. This may be done by placing the toe of the attendant under the front panel 63 and rocking the entire seat about the rounded surface 67.

The seat may be used in a boat for comfort of the infant 42, aside from any consideration of danger. When in a boat, a parent may hold the infant 42 but that detracts from the complete relaxation and enjoyment of the boat ride. Hence the device may be used not only for safety purposes, but for convenience as well, forming an all-purpose device.

What is claimed is:

1. A floatable infant safety seat comprising, a shell having a plurality of elements surrounding the greater part of an interior space, but having an opening communicating with the exterior, the elements including a lower section having a bottom element, side walls, and a back wall, the elements further including a canopy connected to and extending upwardly from the lower section, the shell as thus identified also having a front end and a rear end, the lower section and canopy together forming said opening, and the opening leading generally horizontally from said interior space to the exterior, the canopy having a convex upper surface curved about a longitudinal axis extending through said interior space and below the canopy, the entire safety seat being lighter than water, and the lower section being heavier than the canopy.

2. A safety seat according to claim 1 wherein, the shell contains weights imbedded only in the lower section, and the weights thereby are operable for turning the seat upright in the water.

3. A safety seat according to claim 1 wherein, the shell is made essentially of light plastic material, and a structural metal supporting structure imbedded in the plastic material and extends substantially throughout the area of the shell.

4. A safety seat according to claim 3 wherein, the supporting structure includes U-shape rods and thin metal mesh extending between and secured to elements of the rods.

5. A safety seat according to claim 1 wherein, the lower section determines the length of the shell, and the canopy extends from the rear end of the shell forwardly to a position adjacent to but short of the forward end of the lower section.

6. A safety seat according to claim 5 wherein, the canopy has an outer surface sloping upwardly in a forward direction, and a top peak of said outer surface is rounded to form an essentially point contact upon the seat being inverted and engaged with the water.

7. A safety seat according to claim 1 wherein, the seat has a bottom surface that includes a central panel which assumes a substantially horizontal position when the seat is in upright position, and front and rear panels continuous with the central panel and inclined upwardly in respective directions away from the central panel.

8. A safety seat according to claim 7 wherein, the shell contains weights imbedded in the lower section, said weights include a first weight in the central panel and a second weight in the rear panel.

9. A safety seat according to claim 8 wherein, one of said weights is in a position displaced from the center of the seat in direction as viewed rearwardly from the front.

10. A safety seat according to claim 7 wherein, the rear panel and center panel have lower surfaces merging in a broad cylindrical surface.

11. A safety seat according to claim 1 wherein, the canopy is connected at the rear in a continuous and one-piece construction with the bottom section throughout a substantial length of the canopy, the canopy at the front portion is detached and separate from the bottom section, and the canopy terminates forwardly in a forward extension of substantially less transverse dimension than the remainder of the canopy.

12. A safety seat according to claim 1 and including, a harness having terminal elements imbedded in the material of the shell, and the shell being of one-piece continuous construction.

13. A safety seat according to claim 1 wherein, the shell is constituted entirely by fixed elements, thereby providing access to the interior thereof without moving, or removing, or adjusting any elements.

14. A safety seat according to claim 1 and including, a bail detachably mounted in the side walls of the shell and having a cross bar extending across the seat for mounting playthings for an infant.

* * * * *